US011313332B2

(12) United States Patent
Toriizuka

(10) Patent No.: US 11,313,332 B2
(45) Date of Patent: Apr. 26, 2022

(54) ENGINE INTAKE STRUCTURE

(71) Applicant: KAWASAKI JUKOGYO KABUSHIKI KAISHA, Kobe (JP)

(72) Inventor: Ren Toriizuka, Kobe (JP)

(73) Assignee: KAWASAKI JUKOGYO KABUSHIKI KAISHA

( * ) Notice: Subject to any disclaimer, the term of this patent is extended or adjusted under 35 U.S.C. 154(b) by 0 days.

(21) Appl. No.: 17/025,876

(22) Filed: Sep. 18, 2020

(65) Prior Publication Data

US 2022/0090568 A1 Mar. 24, 2022

(51) Int. Cl.

| | |
|---|---|
| ***F02M 35/10*** | (2006.01) |
| ***F02D 41/00*** | (2006.01) |
| ***F02D 9/08*** | (2006.01) |
| ***F02B 75/22*** | (2006.01) |
| ***F02M 35/116*** | (2006.01) |
| ***F02M 35/024*** | (2006.01) |
| ***F01P 5/02*** | (2006.01) |
| ***F02M 55/02*** | (2006.01) |
| ***F02M 61/14*** | (2006.01) |
| ***F02B 75/18*** | (2006.01) |

(52) U.S. Cl.

CPC ..... *F02M 35/1015* (2013.01); *F01P 5/02* (2013.01); *F02B 75/22* (2013.01); *F02D 9/08* (2013.01); *F02D 41/0002* (2013.01); *F02M 35/024* (2013.01); *F02M 35/10144* (2013.01); *F02M 35/10216* (2013.01); *F02M 35/10249* (2013.01); *F02M 35/116* (2013.01); *F02M 55/025* (2013.01); *F02M 61/145* (2013.01); *F02B 2075/1808* (2013.01)

(58) Field of Classification Search

CPC ..... F02M 35/1015; F02M 35/116; F02M 35/10249; F02M 35/024; F02M 55/025; F02M 35/10216; F02M 61/145; F02M 35/10144; F01P 5/02; F02B 75/22; F02B 2075/1808; F02D 9/08; F02D 41/0002

See application file for complete search history.

(56) References Cited

U.S. PATENT DOCUMENTS 5,996,543 A * 12/1999 Nakayama ..... F02M 35/10249 123/184.21

2014/0034011 A1* 2/2014 Gegg ..... F02B 63/02 123/406.11

FOREIGN PATENT DOCUMENTS

JP 2002256900 A * 9/2002 ..... F02B 75/22

* cited by examiner

*Primary Examiner* — Jacob M Amick
*Assistant Examiner* — Charles J Brauch

(57) ABSTRACT

An intake structure of the present invention is applied to a multi-cylinder engine including an electrically controlled throttle integrally including a throttle valve configured to adjust an amount of air to be supplied to the engine and an electronic control unit configured to control the throttle valve. The engine intake structure includes: an air cleaner configured to purify the air; and an intake manifold configured to distribute the air purified by the air cleaner to an intake port of each cylinder of the multi-cylinder engine. The electrically controlled throttle is attached to the intake manifold such that the electronic control unit is separated outward in a radial direction of an engine rotation shaft.

18 Claims, 5 Drawing Sheets

ENGINE INTAKE STRUCTURE

BACKGROUND OF THE INVENTION

Field of the Invention

The present invention relates to an engine intake structure for supplying air to a multi-cylinder engine.

Description of Related Art

Engines have been known in which an electrically controlled throttle integrally includes: a throttle valve for adjusting an amount of air to be supplied to the engine; and an electronic control unit for controlling the throttle valve. In such an engine, the electronic control unit is arranged facing the inside of the engine in order to prevent foreign matters from colliding with the electronic control unit during engine operation. In such a case, since the electronic control unit is disposed in the vicinity of the engine main body, it is difficult to effectively use the space around the electrically controlled throttle.

DISCLOSURE OF THE INVENTION

An object of the present invention is to provide an engine intake structure that makes it possible to effectively use a space around an electrically controlled throttle.

In order to achieve the above object, an engine intake structure according to a first aspect of the present invention includes:

an electrically controlled throttle integrally including a throttle valve configured to adjust an amount of air to be supplied to a multi-cylinder engine and an electronic control unit configured to control the throttle valve;

an air cleaner configured to purify the air; and an intake manifold configured to distribute the air purified by the air cleaner to an intake port of each cylinder of the multi-cylinder engine, wherein the electrically controlled throttle is attached to the intake manifold such that the electronic control unit is positioned away from the intake manifold in a radial direction of an engine rotation shaft.

According to this configuration, the electrically controlled throttle is attached to the intake manifold such that the electronic control unit is positioned away from the intake manifold in the radial direction of the engine rotation shaft. Thus, a space around the electrically controlled throttle can be effectively used. For example, a fuel pipe may be disposed between the electrically controlled throttle and an engine main body.

In the first aspect of the present invention, the electrically controlled throttle may be coupled to the intake manifold. According to this configuration, since the electrically controlled throttle is coupled to the intake manifold, a vibration difference between the electrically controlled throttle and the intake manifold can be suppressed. Thus, it is possible to simplify or dispense with a vibration damper for suppressing vibration.

In this case, the air cleaner may be fixed to the intake manifold. According to this configuration, a common vibration system is constituted by the air cleaner, the electrically controlled throttle and the intake manifold, and therefore, a vibration difference between the air cleaner and the intake manifold can be suppressed. Thus, it is possible to simplify or eliminate a vibration damper for suppressing vibration.

In the first aspect of the present invention, the electrically controlled throttle may be coupled to the intake manifold by a fastener provided along a flow direction of the air. According to this configuration, the electrically controlled throttle can be attached to the intake manifold without using a dedicated bracket. This makes it possible to suppress an increase in the number of components and to simplify the structure. In addition, the length of the fastener has less influence on the size of a boss, as compared with the case where the electrically controlled throttle is coupled by a fastener extending a direction perpendicular to the air flow path, and therefore, a size increase of the components can be prevented.

In this case, an intake passage connecting the air cleaner and the electrically controlled throttle may extend in a curved manner so as to bypass the fastener. According to this configuration, although there is a thickness or thick portion formed with an attachment hole for the fastener, the thick portion does not narrow down the intake passage. Thus, intake resistance or passage loss remains low.

In the first aspect of the present invention, a circuit board of the electronic control unit of the electrically controlled throttle may be disposed on a plane parallel to an axis of the engine rotation shaft. In this case, the engine may be a V-type two-cylinder engine, and the electrically controlled throttle may be disposed between two cylinders when viewed from an axial direction of the engine rotation shaft. According to this configuration, a space between the two cylinders can be effectively used.

In this case, the circuit board of the electronic control unit of the electrically controlled throttle may be disposed facing a fuel pump of the engine. According to this configuration, a space is defined between the electronic control unit and the engine main body so that the space around the electrically controlled throttle can be effectively used. For example, a fuel pipe connecting the fuel pump and a fuel nozzle of the intake manifold can be disposed in such a space.

In this case, the electrically controlled throttle may be disposed inside a cover of the fuel pump in the radial direction of the engine rotation shaft. According to this configuration, the fuel pump can prevent foreign matters from coming into contact with the electrically controlled throttle. This makes it possible to eliminate a necessity of a dedicated protection cover for the electrically controlled throttle, so as to suppress an increase in the number of components and to simplify the structure.

Where the engine is a V-type two-cylinder engine, the throttle valve of the electrically controlled throttle may have a valve shaft extending parallel to a line connecting centers of the intake ports of the two cylinders. As used herein, the "center of the intake port" refers to the center of an opening of the intake port. According to this configuration, air can be evenly distributed to the respective branch pipes of the intake manifold.

In the first aspect of the present invention, a connector connected to a harness may be provided to a part of the electronic control unit of the electrically controlled throttle, which part is opposite from the fuel pump of the engine. According to this configuration, the electric system and the fuel system can be separately disposed. This facilitates assembly and maintenance of the intake structure.

In the first aspect of the present invention, an electric cable connecting the electrically controlled throttle and the fuel nozzle may be disposed along the intake manifold, and the intake manifold may be formed with a first groove in which the electric cable is arranged. The first groove may be formed by providing a pair of protruding walls on an outer surface of the intake manifold or by providing a recess on the outer surface of the intake manifold. According to this configuration, the electric cable can be arranged in the first groove, and therefore, wiring is facilitated.

In the first aspect of the present invention, the intake manifold may be formed with a second groove in which a grip member gripping the electric cable connecting the electrically controlled throttle and the fuel nozzle is disposed. The second groove may be formed by providing a pair of protruding walls on the outer surface of the intake manifold or by providing a recess on the outer surface of the intake manifold. According to this configuration, the electric cable can be positioned by the grip member, and therefore, wiring is facilitated.

In the first aspect of the present invention, the intake passage between the air cleaner and the intake manifold may include an inclined part extending slantly with respect to the axis of the engine rotation shaft toward a downstream side, and the electrically controlled throttle may be disposed in the inclined part. According to this configuration, since the electronic control unit of the electrically controlled throttle is disposed away from the engine rotation shaft and in a slant manner, it is possible to effectively use a space around the intake manifold and in the vicinity of the engine and to prevent the electronic control unit from protruding outward of the engine. It is also possible to shorten the intake passage and to eliminate a portion of the intake passage, which portion is bent at right angle. Thus, pressure loss of the air flowing through the intake passage can be reduced.

In the first aspect of the present invention, the engine may be an air-cooled engine; a cooling fan configured to cool each cylinder unit of the engine may be disposed on one side of the cylinder unit in the axial direction of the engine rotation shaft; a fuel pipe configured to supply fuel to the fuel nozzle provided to the intake manifold may be disposed along the intake manifold; and the intake manifold may be disposed between the fuel pipe and the cooling fan. According to this configuration, for example, even when the cooling fan blows up foreign matters, the intake manifold protects the fuel pipe from such foreign matters.

An engine intake structure according to a second aspect of the present invention includes:

an electrically controlled throttle integrally including a throttle valve configured to adjust an amount of air to be supplied to a multi-cylinder engine and an actuator configured to drive the throttle valve;

an air cleaner configured to purify the air; and an intake manifold configured to distribute the air purified by the air cleaner to an intake port of each cylinder of the multi-cylinder engine, wherein the electrically controlled throttle is arranged such that a part of the electrically controlled throttle that protrudes radially outward of the engine rotation shaft is disposed in an area opposite from the engine rotation shaft with respect to a throttle body of the electrically controlled throttle.

According to this configuration, the electrically controlled throttle is arranged such that a part of the electrically controlled throttle, which part protrudes radially outward of the engine rotation shaft, is disposed in an area opposite from the engine rotation shaft with respect to the throttle body. That is, the electrically controlled throttle is arranged such that a part of the electrically controlled throttle is separated radially outward from the engine rotation shaft. Thus, a space is defined between the electrically controlled throttle and the engine main body, and therefore, the space around the electrically controlled throttle can be effectively used. For example, a fuel pipe may be disposed between the electronic control unit and the engine main body.

An engine intake structure according to a third aspect of the present invention includes:

a throttle valve configured to adjust an amount of air to be supplied to an air-cooled multi-cylinder engine;

an air cleaner configured to purify the air; and an intake manifold configured to distribute the air purified by the air cleaner to an intake port of each cylinder of the multi-cylinder engine, wherein a cooling fan configured to cool each cylinder unit of the engine is disposed on one side of the cylinder unit in an axial direction of the engine rotation shaft, a fuel pipe configured to supply fuel to a fuel nozzle provided to the intake manifold is disposed along the intake manifold, and the intake manifold is disposed between the fuel pipe and the cooling fan.

According to this configuration, the fuel pipe is disposed along the intake manifold, and the intake manifold is disposed between the fuel pipe and the cooling fan. Thus, for example, even when the cooling fan blows up foreign matters, the intake manifold protects the fuel pipe from such foreign matters.

The present invention encompasses any combination of at least two features disclosed in the claims and/or the specification and/or the drawings. In particular, any combination of two or more of the appended claims should be equally construed as included within the scope of the present invention.

BRIEF DESCRIPTION OF THE DRAWINGS

The present invention will be more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views:

DESCRIPTION OF THE EMBODIMENTS

Hereinafter, a preferred embodiment of the present invention will be described with reference to the drawings. As used herein, the terms "upstream" and "downstream" correspond to "upstream" and "downstream" in a flow direction of an intake air, respectively. An engine E of the present embodiment is a so-called V-type engine in which cylinder axes A1 of two cylinder units 6 extend in a V shape. In the following description, the term "front" and the like refer to a V-bank side, i.e., a direction in which the V shape is opened in a state where the engine is mounted in a machine (for example, a mower or an agricultural machine), and the term "rear" and the like refer to the opposite side. Also, the "vertical direction" and the like refer to an axial direction of the rotation shaft, and the "widthwise direction" and the like refer to a direction perpendicular to both of the vertical direction and the front/rear direction.

Figure 1:
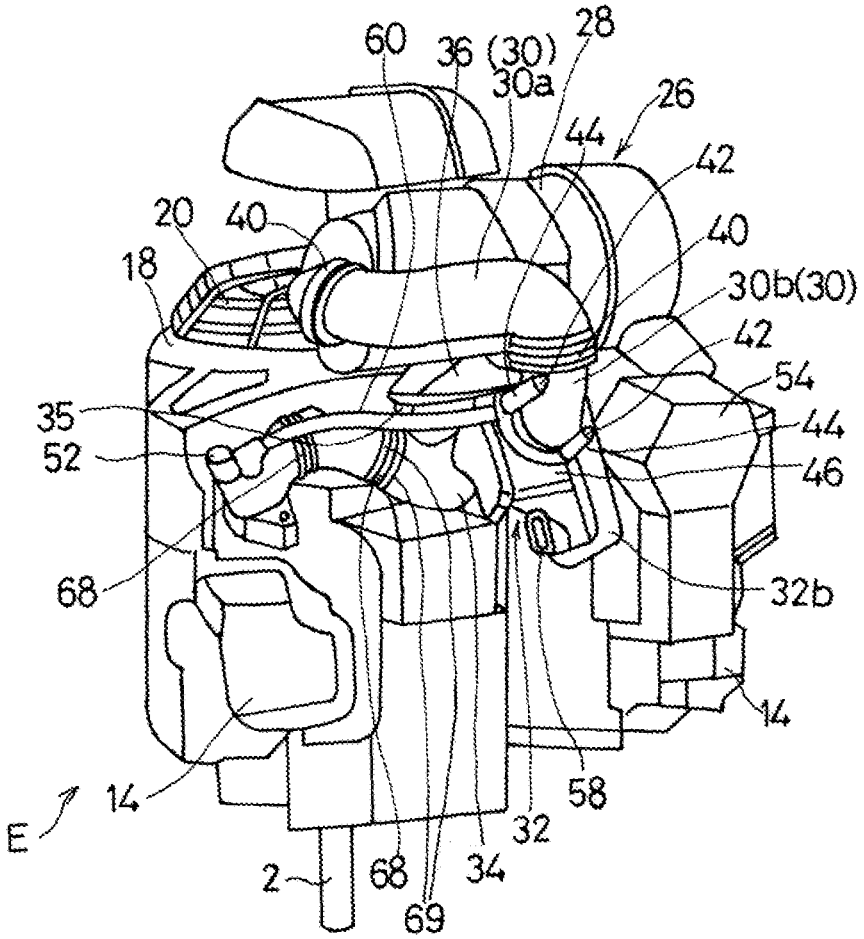
FIG. 1 is a perspective view of an engine including an intake structure according to a first embodiment of the present invention.

FIG. 1 shows an engine E including an intake structure according to a first embodiment of the present invention, the engine being an air-cooled vertical-twin engine having a rotation shaft extending in a vertical direction when mounted. For example, the engine is mounted in a riding mower. However, the type and application of the engine E are not limited to this example.

The engine E of the present embodiment includes: a crankshaft 2 (one example of the engine rotation shaft) having an axis AX extending in the vertical direction; a crankcase 4 supporting the crankshaft 2; and a pair of cylinder units 6, 6 protruding frontward from a front part of the crankcase 4. The crankshaft 2 has a lower end portion to which a power transmission member (not illustrated) for transmitting power to a work tool is attached.

Figure 5:
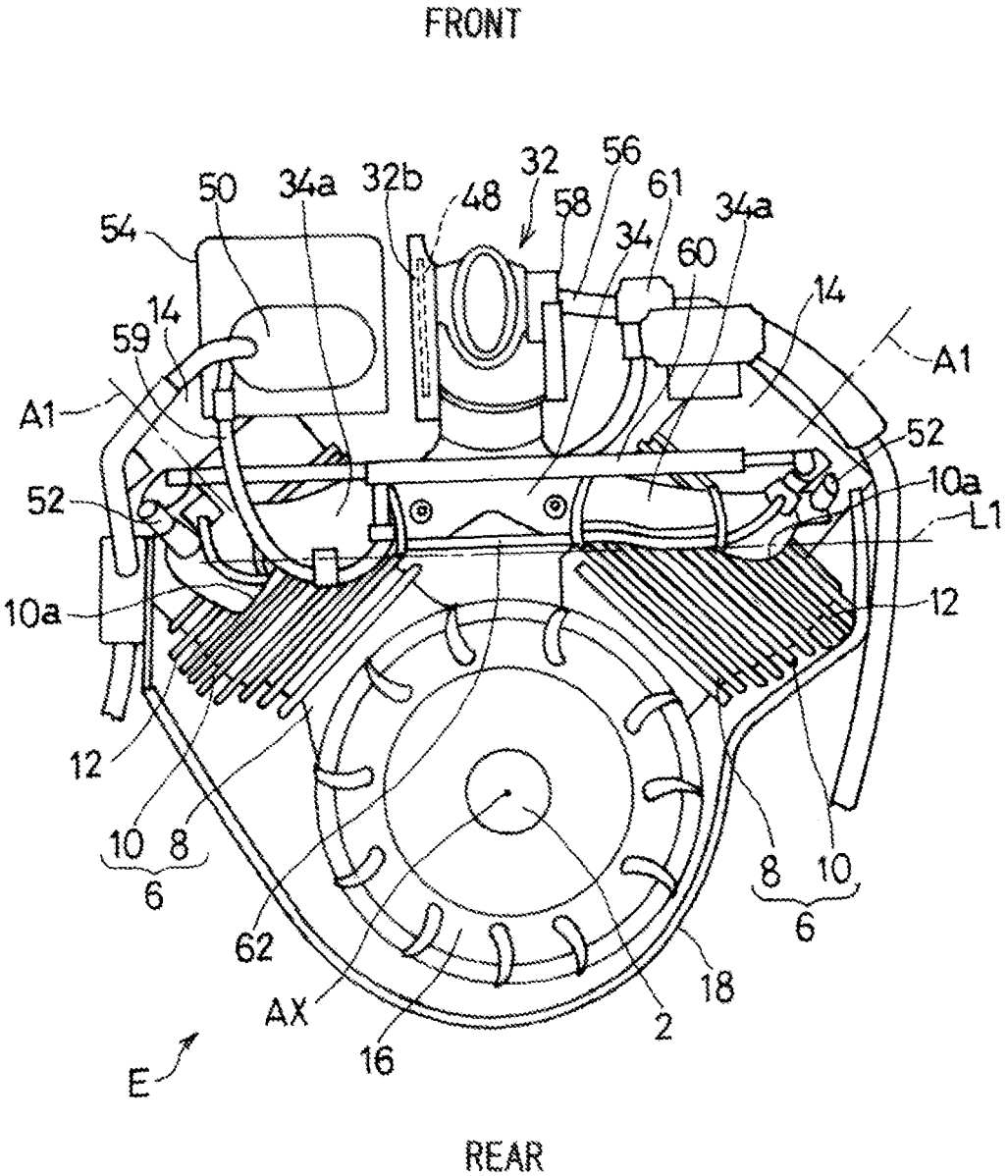
FIG. 5 is a plan view of a main part of the engine.

Each cylinder unit 6 includes: a cylinder 8 having a base end portion coupled to the crankcase 4; and a cylinder head 10 coupled to a protruding end portion of the cylinder 8. As shown in FIG. 5, each cylinder unit 6 has a cylinder axis A1 extending frontward and outward in a slant manner. The cylinder axes A1 of the two cylinder units 6 define a V shape opened frontward.

A cooling fin 12 is formed on an outer periphery of each cylinder unit 6. The cooling fin 12 provides an increased surface area so that the cooling effect of the air-cooled engine is improved. A head cover 14 (FIG. 1) is attached to a front end of each cylinder unit 6.

Figure 2:
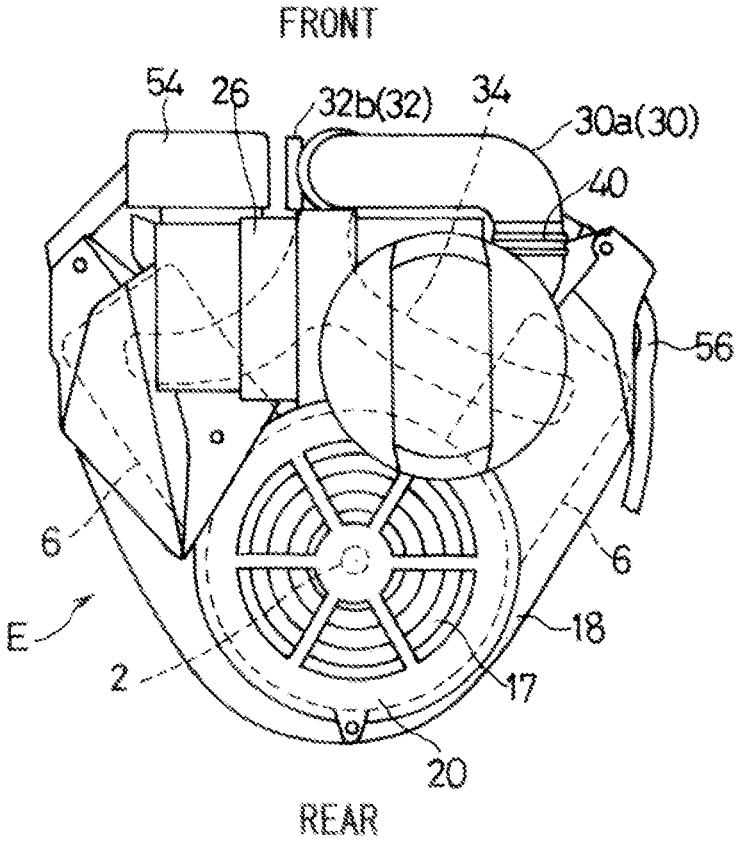
FIG. 2 is a plan view of the engine.

A cooling fan 16 is attached to an upper end of the crankshaft 2. The cooling fan 16 of the present embodiment is constituted by a sirocco fan. The cooling fan 16, however, is not limited to this example. A rotary screen 17 shown in FIG. 2 is attached to an upper end of the cooling fan 16. The cooling air generated by the cooling fan 16 cools the cylinder units 6. The cooling fan 16 is disposed on one side (above in the present embodiment) of the cylinder units 6 in an axial direction AX of the engine rotation shaft 2. A fan housing 18 is attached to the crankcase 4. The fan housing 18 covers an outer periphery and an upper part of the cooling fan 16, except for a front part of the cooling fan.

A fan cover 20 is attached to an upper part of the fan housing 18. The fan cover 20 covers the rotary screen 17 from above and is fixed to the fan housing 18. The fan cover 20 has a plurality of slits, which allow air A to flow through the slits into the fan housing 18. Foreign matters larger than the slits cannot pass through the fan cover 20.

When the engine E is started and causes the crankshaft 2 to rotate, the cooling fan 16 and the rotary screen 17 also rotate integrally with the crankshaft 2. As the cooling fan 16 rotates, air A is sucked into the fan housing 18 through the fan cover 20 from above the engine E. The air A having flown into the fan housing 18 is guided downward in the fan housing 18, so as to cool cooling target components such as the cylinder units 6, 6. Although grass clippings smaller than the openings of the fan cover 20 may pass through the fan cover 20, they will be finely shredded by the rotary screen 17 and discharged outside from the gap between the crankcase 4 and the fan housing 18.

An air cleaner 26 is disposed at a location away from the cylinder units 6 in the axial direction AX of the engine rotation shaft 2, as shown in FIG. 1. In the present embodiment, the air cleaner is disposed above the cylinder units 6. The air cleaner 26 includes a cleaner element (not illustrated) inside a cleaner casing 28 and is configured to introduce and purify (filter) the outside air.

The air A having been purified by the air cleaner 26 passes through an intake pipe 30 and an electrically controlled throttle 32, and then, is distributed to respective cylinders by an intake manifold 34 that is branched to the left and right. The air cleaner 26 has an outlet to which an upstream end of the intake pipe 30 is connected, and the intake pipe 30 has a downstream end to which an inlet of the electrically controlled throttle 32 is connected. That is, the intake pipe 30 defines an intake passage between the air cleaner 26 and the electrically controlled throttle 32.

The electrically controlled throttle 32 includes: a throttle valve 32*a* (FIG. 3) for adjusting an amount of the air to be supplied to the engine; an electronic control unit 32*b* for controlling the throttle valve 32*a*; and a throttle body 32*c* having an intake passage formed therein, the throttle valve 32*a* and the electronic control unit 32*b* being integrated with the throttle body 32*c*. In other words, the electrically controlled throttle 32 includes: the throttle body 32*c*; a throttle valve 32*a* disposed inside the throttle body 32*c*; a valve shaft 32*d* of the throttle valve 32*a*; and the electronic control unit 32*b*.

The throttle valve 32*a* is, for example, a butterfly valve and adjusts an amount of the air A flowing into the intake passage in accordance with a command from the electronic control unit 32*b*. The electronic control unit 32*b* includes a circuit board 48 on which an electronic circuit is implemented, and controls the throttle valve 32*a* using an actuator to which the valve shaft 32*d* is coupled. In the present embodiment, the actuator is disposed on an outer surface of the throttle body 32*c* that is opposite from the electronic control unit 32*b*. The electronic control unit 32*b* is provided with a connector 58 (which will be described later) to an electric system. The throttle valve 32*a*, however, is not limited to a butterfly valve.

The electrically controlled throttle 32 has an outlet to which an upstream end of the intake manifold 34 is connected. That is, the intake pipe and the electrically controlled throttle 32 constitute the intake passage between the air cleaner 26 and the manifold 34. The intake manifold 34 is brunched into two passages at an intermediate position in a flow direction of the air, and downstream ends of the passages are connected to intake ports 10*a* (FIG. 5) of the two cylinder heads 10. The air cleaner 26, the intake pipe 30, the electrically controlled throttle 32, and the intake manifold 34 cooperate together to constitute the engine intake structure.

Figure 3:
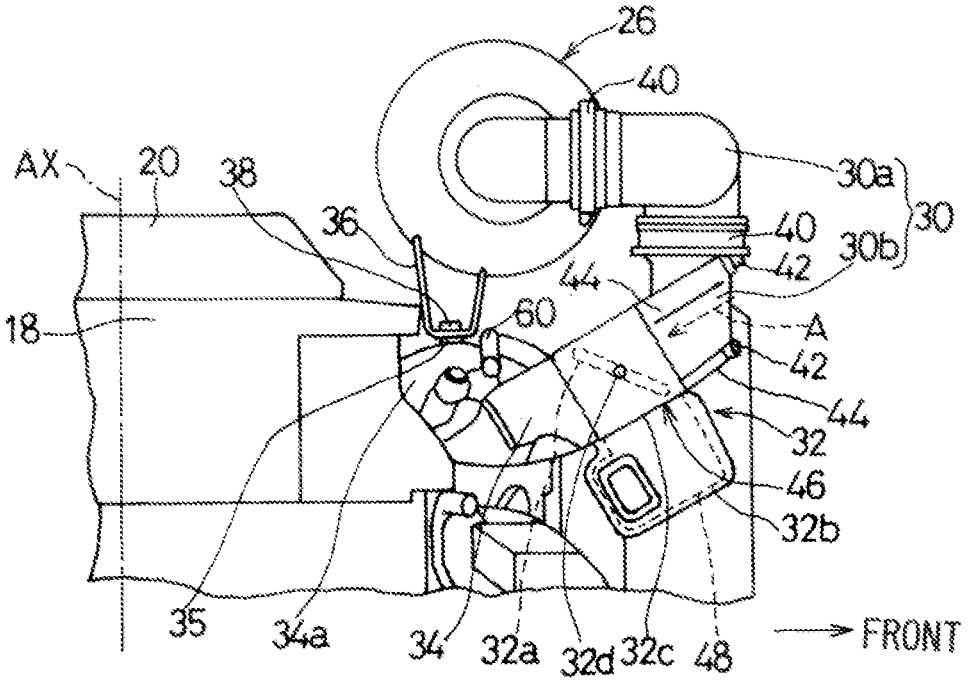
FIG. 3 is a side view of the intake structure.

The air cleaner 26 is removably attached to the intake manifold 34. Specifically, as shown in FIG. 3, an upwardly protruding boss 35 is formed on an upper surface of the intake manifold 34, and a bracket 36 is attached to a lower surface of the air cleaner 26. A bolt 38 is inserted through an insertion hole 36*a* (FIG. 6) of the bracket 36 and screwed into a threaded hole (not illustrated) of the boss 35 so that the air cleaner 26 is attached to the intake manifold 34. Attachment of the air cleaner 26 to the intake manifold 34 is not limited to this fashion.

The intake pipe 30 includes: an upstream-side intake pipe 30*a* which extends in front of the air cleaner 26 in a widthwise direction of the engine E and is then curved downward; and a downstream-side intake pipe 30*b* which is curved rearward and downward in a slant manner from the upstream-side intake pipe 30*a* and connected to the electrically controlled throttle 32. In the present embodiment, the upstream-side intake pipe 30*a* is constituted by e.g. a rubber duct, and the opposite end portions of the upstream-side intake pipe 30*a* are fixed to the outlet of the air cleaner 26 and the downstream-side intake pipe 30*b* by clamping members 40. The upstream-side intake pipe 30*a* may be made of a different material and/or be fixed in a different manner. The downstream-side intake pipe 30*b* is a metal pipe, and the downstream end portion of the downstream-side intake pipe is coupled to the electrically controlled throttle 32.

The electrically controlled throttle 32 is disposed below the air cleaner 26. Also, as shown in FIG. 5, the electrically controlled throttle 32 is disposed between the two cylinders (cylinder units) 6, 6 when viewed from the axial direction AX of the engine rotation shaft 2. In the present embodiment, the electrically controlled throttle 32 is disposed between the two cylinders (cylinder units) 6, 6 in a plan view.

The electrically controlled throttle 32 is removably attached to the intake manifold 34. Specifically, the electrically controlled throttle 32 is coupled to the intake manifold 34 by stud bolts 42 that are a type of fasteners and extend substantially along the flow direction of the air as shown in FIG. 3. Although there are two stud bolts 42 in the present embodiment, the number of the stud bolts 42 is not limited to this example. The fasteners are not limited to stud bolts.

The electrically controlled throttle 32 is held between the downstream-side intake pipe 30*b* and the intake manifold 34 by the stud bolts 42. As shown in FIG. 1, the electrically controlled throttle 32 is formed with two tubular bosses 44 on a diagonal line across the intake passage. The bosses 44 are formed so as to extend parallel to the flow direction of the air A. The stud bolts 42 are inserted through hollow holes (not illustrated) of the bosses 44 as shown in FIG. 3 and insertion holes (not illustrated) defined in the electrically controlled throttle 32, and then, is screwed into threaded holes (not illustrated) defined in the bosses 44 of the intake manifold 34. The electrically controlled throttle 32 and the downstream-side intake pipe 30*b* are thereby attached to the intake manifold 34.

Thus, since the air cleaner 26, the intake pipe 30 and the electrically controlled throttle 32 are supported by the intake manifold 34, the engine intake structure of the present embodiment constitutes a common vibration system.

The bosses 44, 44 of the downstream-side intake pipe 30*b* are provided on the left and right sides of the intake passage (opposite sides in the widthwise direction of the engine E), and the intake passage inside the downstream-side intake pipe 30*b* is curved so as to bypass the bosses 44, 44 as shown in FIG. 1, so that the bosses 44, 44 do not interfere with the intake passage. In other words, an axis A2 of the intake passage inside the downstream-side intake pipe 30*b* extends in a curved manner so as to bypass the stud bolts 42. It should be noted that the bosses 44, 44 do not necessarily arranged so as to be aligned in the widthwise direction of the engine E, and, for example, they may be arranged so as to be aligned in the vertical direction of the engine E (axial direction AX of the engine rotation shaft 2).

As described above, the downstream-side intake pipe 30*b* is curved rearward and downward in a slant manner from the upstream-side intake pipe 30*a* and connected to the electrically controlled throttle 32. That is, the intake passage between the air cleaner 26 and the manifold 34 (specifically, the intake passage between the downstream-side intake pipe 30*b* and the manifold 34 as shown in FIG. 3) includes an inclined part 46 extending stantly with respect to the axis AX of the engine rotation shaft 2 toward a downstream side (rearward). More specifically, the inclined part 46 is inclined downward so as to approach the axis AX of the engine rotation shaft 2. The electrically controlled throttle 32 is disposed in such an inclined part 46. That is, the intake passage defined by the throttle body 32*c* of the electrically controlled throttle 32 constitutes the inclined part 46. In the present embodiment, the inclined part 46 extends slantly downward toward the downstream side.

The valve shaft 32*d* of the throttle valve 32*a* of the electrically controlled throttle 32 extends parallel to a line L1 connecting centers of the intake ports 10*a* of the cylinder heads 10. In other words, the valve shaft 32*d* extends in a direction in which the two cylinder heads 10 are aligned. As used herein, the "center of the intake port 10*a*" refers to the center of an opening of the intake port 10*a*. In the present embodiment, the valve shaft 32*d* extends horizontally in the widthwise direction of the engine E. In other words, the valve shaft 32*d* extends in the direction of extension of the branch pipes 34*a* of the intake manifold 34. Thus, the air can be evenly distributed to the respective branch pipes (respective cylinders) of the intake manifold 34.

As shown in FIG. 3, the electrically controlled throttle 32 is attached to the intake manifold 34 such that the electronic control unit 32*b* is separated outward in the radial direction of the engine rotation shaft 2 with respect to the throttle body 32*c*. In the present embodiment, the electrically controlled throttle 32 is attached to the intake manifold 34 such that the electronic control unit 32*b* is separated outward from the air cleaner 26 in the radial direction of the engine rotation shaft 2. In other words, the electrically controlled throttle 32 includes a part thereof that protrudes radially outward of the engine rotation shaft 2 in an area opposite from the engine rotation shaft 2 with respect to the throttle body 32*c*.

A surface of the circuit board 48 of the electronic control unit 32*b* of the electrically controlled throttle 32, which surface is perpendicular to a thickness direction thereof, is arranged on a plane parallel to the axis AX of the engine rotation shaft 2. Specifically, the circuit board 48 is arranged on a plane including the axis AX of the engine rotation shaft 2.

As shown in FIG. 5, the intake manifold 34 has an upstream end connected to an outlet of the electrically controlled throttle 32 and is branched into two branch pipes 34*a* on the downstream side of the intake manifold 34. The respective branch pipes 34*a* extend outward in the widthwise direction of the engine and are curved downward so as to be connected to the intake ports 10*a* of the cylinder heads 10. A fuel nozzle or injector 52 is attached to each of the branch pipes 34*a*. The fuel nozzle 52 sprays fuel into the intake passage so as to generate an air-fuel mixture, and the air-fuel mixture is supplied to the intake ports 10*a*.

A fuel pump 50 is disposed at one side portion of a front part of the engine in the widthwise direction (i.e., on the left side in FIG. 5). The fuel pump 50 supplies the fuel to the fuel nozzles 52 provided to the intake manifold 34. An outer surface of the fuel pump 50 is covered by a cover 54. In the present embodiment, with respect to the widthwise direction of the engine E, the fuel pump 50 is disposed at one side portion in the widthwise direction of the electrically controlled throttle 32 (on the left side in FIG. 5). With respect to the vertical direction (axial direction of the engine rotation shaft 2) and the front/rear direction, the fuel pump 50 is disposed at a substantially the same position as that of the electrically controlled throttle 32.

The circuit board 48 of the electronic control unit 32*b* of the electrically controlled throttle 32 is disposed facing the fuel pump 50. Specifically, a main surface of the circuit board 48 faces the fuel pump 50 and is disposed parallel to a side surface of the cover 54. Also, the electrically controlled throttle 32 is disposed inside the cover 54 of the fuel pump 50 in the radial direction of the engine rotation shaft 2. In other words, the electrically controlled throttle 32 is located inside the cover 54 of the fuel pump 50 in the radial direction of the engine rotation shaft 2.

A connector 58 connected to a harness 56 is provided to a part of the electronic control unit 32*b* of the electrically controlled throttle 32, which part is opposite from the fuel pump 50. Specifically, the connector 58 is disposed on a side of the electronic control unit 32*b* opposite from the fuel pump 50 (on the right side in FIG. 5). The harness 56 extends in front of the engine E in the widthwise direction of the engine (on the right side in FIG. 5) and is connected to the electric system (not illustrated) of the vehicle.

A fuel pipe 60 connecting the fuel pump 50 and the fuel nozzle 52 of the intake manifold 34 is disposed along the intake manifold 34. Specifically, the fuel pipe 60 extends in the widthwise direction along the branch pipes 34*a* of the intake manifold 34 so as to supply the fuel, delivered from a discharge pipe 59 at the outlet of the fuel pump 50, to the fuel nozzles 52, 52. In the present embodiment, the branch pipes 34*a* of the intake manifold 34 are disposed between the fuel pipe 60 and the cooling fan 16 in a plan view.

An electric cable 62 of the fuel nozzles 52 is also disposed along the intake manifold 34. Specifically, the electric cable 62 is branched from the harness 56 through a branch connector 61 and extends along the branch pipes 34*a* of the intake manifold 34 in the widthwise direction of the engine, so as to be connected to the fuel nozzles 52.

Figure 6:
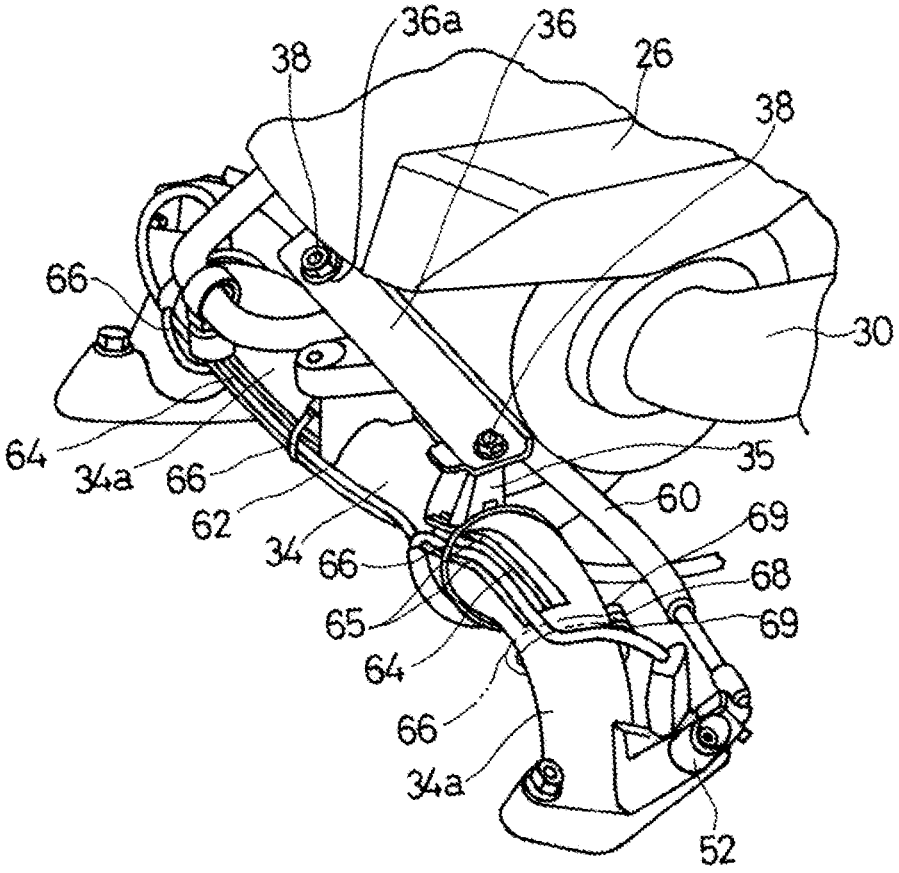
FIG. 6 is a perspective view of an intake manifold of the intake structure.

As shown in FIG. 6, the intake manifold 34 is formed with a first groove 64, in which the electric cable 62 is disposed, on an outer surface of the intake manifold 34. That is, the first groove 64 is formed on the outer surface of the intake manifold 34 in a direction along a pipe axis of the intake manifold 34. In the present embodiment, two protrusions 65 are formed so as to protrude from the outer surface of the intake manifold 34 and extend parallel to each other in the widthwise direction of the engine E, and the first groove 64 is formed between the two protrusions 65. The structure of the first groove 64 is not limited to this example. For instance, the first groove may be a recess formed on the outer surface of the manifold 34. The first groove 64 may be formed over an entirety of or only a part of the branch pipes 34*a*. It is also possible to form a plurality of such first grooves 64 separately from one another in the widthwise direction of the engine E.

Figure 4:
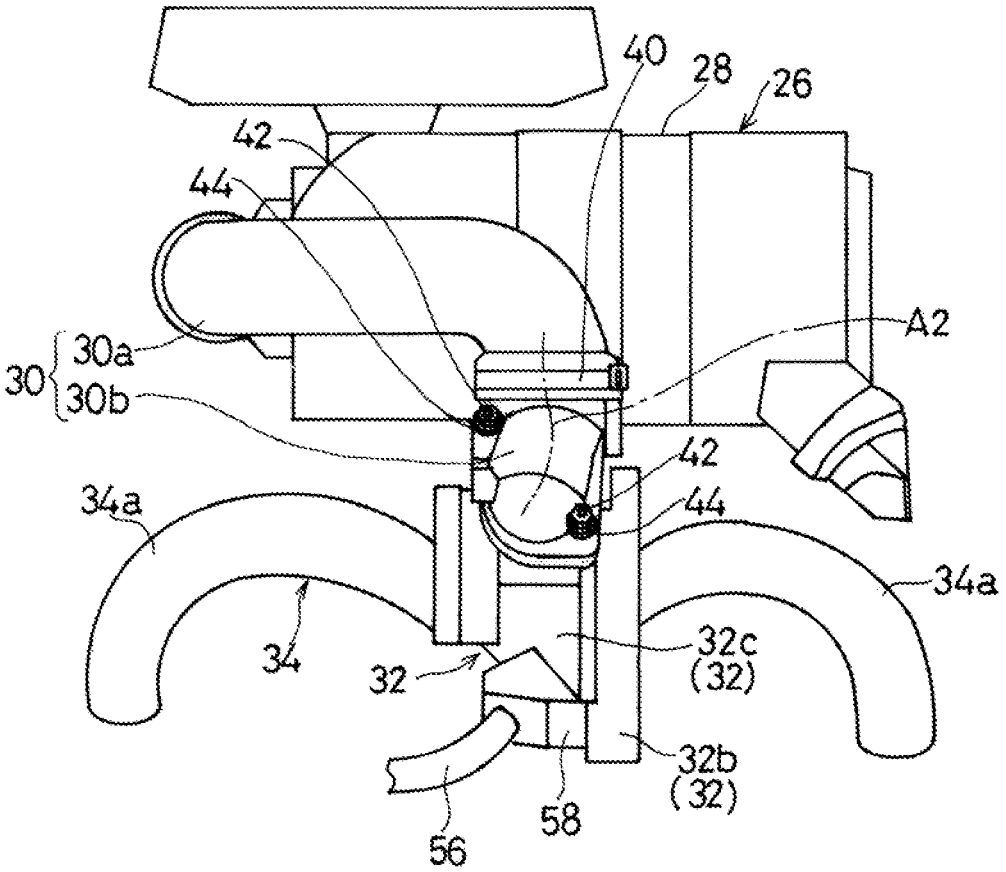
FIG. 4 is a front view of the intake structure.

Further, the intake manifold 34 is formed with a second groove 68, in which a grip member 66 for gripping the electric cable 62 is disposed, on the outer surface of the intake manifold 34. That is, the second groove 68 is formed on the outer surface of the intake manifold 34 along a circumferential direction of the intake manifold 34. The grip member 66 is, for example, a band member or a clamping member. FIG. 6 shows one of such grip members 66 with a double dotted line. In the present embodiment, as shown in FIG. 4, two protrusions 69 are formed so as to protrude from the outer surface of the intake manifold 34 and extend parallel to each other in the circumferential direction of the branch pipes 34*a*, and the second groove 68 is formed between the two protrusions 69. The structure of the second groove 68 is not limited to this example. For instance, the second groove may be a recess formed on the outer surface of the manifold 34. Although, in the present embodiment, there are a plurality of the second grooves 68 separated in a direction along the pipe axis of each branch pipe 34*a*, there may be a single second groove. The first and second grooves 64, 68 may be omitted.

According to the above configuration, as shown in FIG. 3, the electrically controlled throttle 32 is attached to the intake manifold 34 such that the electronic control unit 32*b* is separated outward in the radial direction of the engine rotation shaft 2. In other words, the electrically controlled throttle 32 is disposed such that the electronic control unit 32*b* or a part of the electrically controlled throttle, which part protrudes outward in the radial direction of the engine rotation shaft 2, is disposed in an area opposite from the engine rotation shaft 2 with respect to the throttle body 32*c*. That is, the electrically controlled throttle 32 is disposed such that a part of the electrically controlled throttle 32 is positioned away from the intake manifold 34 in the radial direction of the engine rotation shaft 2. Thus, a space is defined between the electrically controlled throttle 32 and the engine main body, and therefore, the space around the electrically controlled throttle 32 can be effectively used. As a result, the fuel pipe 60 can be disposed between the electrically controlled throttle 32 and the engine main body.

The air cleaner 26 and the electrically controlled throttle 32 are removably attached to the intake manifold 34. According to this configuration, a common vibration system is constituted by the air cleaner 26, the electrically controlled throttle 32 and the intake manifold 34, and therefore, a vibration difference between the air cleaner 26, the electrically controlled throttle 32, and the intake manifold 34 can be suppressed. Thus, it is possible to simplify or dispense with a vibration damper for suppressing vibration.

The electrically controlled throttle 32 is coupled to the intake manifold 34 by stud bolts 42 provided along the flow direction of the air. According to this configuration, the electrically controlled throttle 32 can be attached to the intake manifold 34 without using a dedicated bracket. This makes it possible to suppress an increase in the number of components and to simplify the structure.

As shown in FIG. 1, the intake passage (axis A2) connecting the air cleaner 26 and the electrically controlled throttle 32 extends in a curved manner so as to bypass the stud bolts 42. Thus, a thick portion or thickness 45 formed with the boss 44 for inserting the stud bolt 42 does not narrow down the intake passage. Thus, intake resistance or passage loss remains low.

As shown in FIG. 5, the electrically controlled throttle 32 is disposed between the two cylinders of the V-type engine. Thus, it is possible to effectively use a space between the two cylinders. As shown in FIG. 3, the valve shaft 32*d* of the throttle valve 32*a* of the electrically controlled throttle 32 extends parallel to a line L1 connecting the intake ports 10*a* of the two cylinders. Thus, the air can be evenly distributed to the respective branch pipes 34*a* of the intake manifold 34.

As shown in FIG. 5, the circuit board 48 of the electronic control unit 32*b* of the electrically controlled throttle 32 is disposed on a plane including the axis of the engine rotation shaft 2 and faces the fuel pump 50. Thus, a space is defined between the electronic control unit 32*b* and the engine main body, so that the space around the electrically controlled throttle 32 can be effectively used. The fuel pipe 60 connecting the fuel pump 50 and the fuel nozzles 52 may be disposed in such a space.

The electrically controlled throttle 32 is disposed inside the cover 54 of the fuel pump 50 in the radial direction of the engine rotation shaft 2. Therefore, the cover 54 of the fuel pump 50 can prevent foreign matters from coming into contact with the electrically controlled throttle 32. This makes it possible to eliminate a necessity of a dedicated protection cover for the electronic control unit 32*b*, so as to suppress an increase in the number of components and to simplify the structure.

The connector 58 connected to the harness 56 is provided to a part of the electronic control unit 32*b* of the electrically controlled throttle 32, which part is opposite from the fuel pump 50. This makes it possible to separately dispose the electric system and the fuel system. That is, fuel-related devices are collectively disposed on one side (on the left side in FIG. 5) in the widthwise direction of the engine E, and electricity-related devices are collectively disposed on the other side (on the right side in FIG. 5) in the widthwise direction of the engine E. This facilitates assembly and maintenance of the intake structure.

As shown in FIG. 6, the electric cable 62 connecting the electrically controlled throttle 32 and the fuel nozzle 52 is disposed along the intake manifold 34, and the intake manifold 34 is formed with the first groove 64 in which the electric cable 62 is disposed. This facilitates wiring of the electric cable 62. Further, the intake manifold 34 is formed with the second groove 68 in which the grip member 66 for gripping the electric cable 62 is disposed. Thus, the electric cable 62 can be supported and positioned by the grip member 66 so that wiring is facilitated.

The intake passage between the air cleaner 26 and the manifold 34 in FIG. 4 includes the inclined part 46 extending slantly with respect to the axis AX of the engine rotation shaft 2 toward the downstream side, and the electrically controlled throttle 32 is disposed in the inclined part 46. Thus, since the electronic control unit 32*b* of the electrically controlled throttle 32 is disposed away from the engine rotation shaft 2 in a slant manner, it is possible to effectively use a space around the intake manifold 34 and in the vicinity of the engine and to suppress protrusion of the electronic control unit 32*b* outward of the engine E. It is also possible to shorten the intake passage and to eliminate a portion of the intake passage, which portion is bent at right angle. Thus, pressure loss of the air flowing through the intake passage can be reduced.

As shown in FIG. 5, the fuel pipe 60 for supplying the fuel to the fuel nozzles 52 provided to the intake manifold 34 is disposed along the intake manifold 34, and the intake manifold 34 is disposed between the fuel pipe 60 and the cooling fan 16. Thus, even when the cooling fan 16 blows up foreign matters, the intake manifold 34 protects the fuel pipe 60 from such foreign matters.

The present invention is not intended to be limited to the above embodiment, and various addition, changes, or deletions may be made without departing from the scope of the invention. For example, although the air cleaner 26, the throttle body 32*d* and the electronic control unit 32*b* are aligned in this order in the vertical direction (axial direction of the engine rotation shaft 2) in the above embodiment, they may be aligned in the front/rear direction (radial direction of the engine rotation shaft 2). That is, the circuit board 48 of the electronic control unit 32*b* may face outward in the radial direction of the engine rotation shaft 2. Also, although the above embodiment has been described with reference to an example where an intake structure of the present invention is applied to a V-type two-cylinder engine, the intake structure of the present invention may be applied to engines other than V-type two-cylinder engines. Accordingly, such variants should also be included within the scope of the present invention.

REFERENCE NUMERALS

6 . . . Cylinder unit
10*a* . . . Intake port
16 . . . Cooling fan
26 . . . Air cleaner
30 . . . Intake pipe (intake passage)
32 . . . Electrically controlled throttle (intake passage)
32*a* . . . Throttle valve
32*b* . . . Electronic control unit
32*d* . . . Valve shaft
34 . . . Intake manifold
42 . . . Stud bolt (fastener)
46 . . . Inclined part
48 . . . Circuit board
50 . . . Fuel pump
52 . . . Fuel nozzle
54 . . . Fuel pump cover
56 . . . Harness
58 . . . Connector
60 . . . Fuel pipe
62 . . . Electric cable
64 . . . First groove
66 . . . Grip member
68 . . . Second groove
AX . . . Axis of the engine rotation shaft
E . . . Engine
L1 . . . Line connecting the intake ports

What is claimed:

1. An engine intake structure comprising:
an electrically controlled throttle including:
a throttle body having an intake passage formed therein;
a throttle valve configured to adjust an amount of air to be supplied to a multi-cylinder engine, the throttle valve being disposed inside the throttle body; and
an electronic control unit configured to control the throttle valve, the electronic control unit being attached to an outer surface of the throttle body;
the throttle valve and the electronic control unit being integrated with the throttle body;
an air cleaner configured to purify the air; and
an intake manifold configured to distribute the air purified by the air cleaner to an intake port of each cylinder of the multi-cylinder engine, wherein
the electrically controlled throttle is attached to the intake manifold such that the electronic control unit is positioned away from the intake manifold in a radial direction of an engine rotation shaft, and
the electrically controlled throttle is arranged such that a part of the electrically controlled throttle that protrudes radially outward of the engine rotation shaft is disposed in an area opposite from the engine rotation shaft with respect of a throttle body of the electrically controlled throttle.

2. The engine intake structure as claimed in claim 1, wherein the electrically controlled throttle is coupled to the intake manifold.

3. The engine intake structure as claimed in claim 2, wherein the air cleaner is fixed to the intake manifold.

4. The engine intake structure as claimed in claim 1, wherein the electrically controlled throttle is coupled to the intake manifold by a fastener provided along a flow direction of the air.

5. An engine intake structure comprising:
an electrically controlled throttle integrally including a throttle valve configured to adjust an amount of air to be supplied to a multi-cylinder engine and an electronic control unit configured to control the throttle valve;
an air cleaner configured to purify the air; and an intake manifold configured to distribute the air purified by the air cleaner to an intake port of each cylinder of the multi-cylinder engine, wherein the electrically controlled throttle is coupled to the intake manifold by a fastener provided along a flow direction of the air, and an intake passage connecting the air cleaner and the electrically controlled throttle extends in a curved manner so as to bypass the fastener.

6. An engine intake structure comprising:

an electrically controlled throttle integrally including a throttle valve configured to adjust an amount of air to be supplied to a multi-cylinder engine and an electronic control unit configured to control the throttle valve;

an air cleaner configured to purify the air; and an intake manifold configured to distribute the air purified by the air cleaner to an intake port of each cylinder of the multi-cylinder engine, wherein the electrically controlled throttle is attached to the intake manifold such that the electronic control unit is positioned away from the intake manifold in a radial direction of an engine rotation shaft, and the electrically controlled throttle is disposed inside a cover of a fuel pump in the radial direction of the engine rotation shaft.

7. The engine intake structure as claimed in claim 1, wherein a connector connected to a harness is provided to a part of the electronic control unit of the electrically controlled throttle, which part is opposite from a fuel pump of the engine.

8. An engine intake structure comprising:

an electrically controlled throttle integrally including a throttle valve configured to adjust an amount of air to be supplied to a multi-cylinder engine and an electronic control unit configured to control the throttle valve;

an air cleaner configured to purify the air; and an intake manifold configured to distribute the air purified by the air cleaner to an intake port of each cylinder of the multi-cylinder engine, wherein an electric cable connecting the electrically controlled throttle and a fuel nozzle is disposed along the intake manifold, and the intake manifold is formed with:

a first groove in which the electric cable is arranged; or a second groove in which a grip member gripping an electric cable connecting the electrically controlled throttle and a fuel nozzle is disposed.

9. The engine intake structure as claimed in claim 1, wherein an intake passage between the air cleaner and the intake manifold includes an inclined part extending slantly with respect to an axis of the engine rotation shaft toward a downstream side, and the electrically controlled throttle is disposed in the inclined part.

10. The engine intake structure as claimed in claim 1, wherein the engine is an air-cooled engine;

a cooling fan configured to cool each cylinder unit of the engine is disposed on one side of the cylinder unit in an axial direction of the engine rotation shaft;

a fuel pipe configured to supply fuel to a fuel nozzle provided to the intake manifold is disposed along the intake manifold; and the intake manifold is disposed between the fuel pipe and the cooling fan.

11. The engine intake structure as claimed in claim 1, wherein the electronic control unit controls the throttle valve with use of an actuator, and the actuator is disposed on an outer surface of the throttle body that is opposite from the electronic control unit.

12. The engine intake structure as claimed in claim 1, wherein the electronic control unit includes a circuit board on which an electronic circuit is implemented, and a surface of the circuit board, which surface is perpendicular to a thickness direction of the circuit board, is arranged on a plane parallel to an axis of the engine rotation shaft.

13. The engine intake structure as claimed in claim 5, wherein the electrically controlled throttle is attached to the intake manifold such that the electronic control unit is positioned away from the intake manifold in a radial direction of an engine rotation shaft.

14. The engine intake structure as claimed in claim 8, wherein the electrically controlled throttle is attached to the intake manifold such that the electronic control unit is positioned away from the intake manifold in a radial direction of an engine rotation shaft.

15. The engine intake structure as claimed in claim 6, wherein a circuit board of the electronic control unit of the electrically controlled throttle is disposed on a plane parallel to an axis of the engine rotation shaft.

16. The engine intake structure as claimed in claim 15, wherein the engine is a V-type two-cylinder engine, and the electrically controlled throttle is disposed between two cylinders when viewed from an axial direction of the engine rotation shaft.

17. The engine intake structure as claimed in claim 16, wherein a circuit board of the electronic control unit of the electrically controlled throttle is disposed facing a fuel pump of the engine.

18. The engine intake structure as claimed in claim 16, wherein the throttle valve of the electrically controlled throttle has a valve shaft extending parallel to a line connecting centers of the intake ports of the two cylinders.

* * * * *